US008733921B2

(12) United States Patent
Korem

(10) Patent No.: US 8,733,921 B2
(45) Date of Patent: May 27, 2014

(54) METHOD OF INK JET PRINTING WITH IMAGE QUALITY CONTROL

(75) Inventor: Aharon Korem, Herzlia (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 2168 days.

(21) Appl. No.: 11/665,850

(22) PCT Filed: Oct. 16, 2005

(86) PCT No.: PCT/IL2005/001087
§ 371 (c)(1),
(2), (4) Date: Nov. 12, 2007

(87) PCT Pub. No.: WO2006/043269
PCT Pub. Date: Apr. 27, 2006

(65) Prior Publication Data

US 2008/0088689 A1 Apr. 17, 2008

(30) Foreign Application Priority Data

Oct. 19, 2004 (IL) ..... 164679

(51) Int. Cl.
*B41J 29/38* (2006.01)
*B41J 2/14* (2006.01)
*B41J 2/01* (2006.01)

(52) U.S. Cl.
USPC ..... 347/102; 347/6; 347/51

(58) Field of Classification Search
USPC ..... 347/1, 5, 6, 20, 51, 101, 102
See application file for complete search history.

(56) References Cited

U.S. PATENT DOCUMENTS

| | | | | |
|---|---|---|---|---|
| 6,849,308 | B1 * | 2/2005 | Speakman et al. | 427/595 |
| 2003/0063172 | A1 * | 4/2003 | Ohtsu et al. | 347/102 |
| 2004/0085423 | A1 * | 5/2004 | Bronstein et al. | 347/102 |
| 2004/0122106 | A1 | 6/2004 | Ohta et al. | |
| 2004/0141040 | A1 * | 7/2004 | Nakajima | 347/102 |

FOREIGN PATENT DOCUMENTS

| | | | |
|---|---|---|---|
| EP | 0385417 | A | 9/1990 |
| WO | WO 01/38097 | A | 5/2001 |

* cited by examiner

*Primary Examiner* — Alessandro Amari
*Assistant Examiner* — Kendrick Liu

(57) ABSTRACT

Disclosed is a method and apparatus for improving printed image quality. The image quality improvement is achieved by differentially curing different image elements such as continuous tone elements, uniform tinted and solid elements, color elements, line art and text elements. A delay in the activation, duration and variation in the intensity of the curing radiation or a mix of some or all of them that follows the ink droplet on substrate deposition controls the ink droplet spread and accordingly the image quality.

30 Claims, 11 Drawing Sheets

METHOD OF INK JET PRINTING WITH IMAGE QUALITY CONTROL

FIELD OF THE INVENTION

The invention relates to inkjet printing and in particular to printing with curable inks.

BACKGROUND OF THE INVENTION

Inkjet printing is a well known in the art printing method. The basics of this technology are described, for example by Jerome L. Johnson <<Principles of Nonimpact Printing>>, Palatino Press, 1992, Pages 302-336. ISBN 0-9618005-2-6. Commercial products such as computer printers, large format graphics printers and others exist.

An inkjet print head consists of an array or a matrix of ink nozzles, with each nozzle selectively ejecting ink droplets. A given nozzle of the print head ejects the droplet in a predefined print position on the media. An assembly of the adjacently positioned on the media ink droplets creates a predetermined print pattern or image. Each image typically consists of multiple image elements such as pictorial or continuous tone elements, uniform tinted and solid elements, and line art and text elements. Color is another image element. Faithful reproduction of each image element is characterized by proper image sharpness, smoothness, spot size and other image quality parameters.

Inks used in the ink-jet printing industry are typically liquid solutions or emulsions. Known types of ink are oil-based inks, non-aqueous solvent-based inks, water-based inks, and solid inks. The deposited ink droplets are dried or cured. Recently, curing of ink by radiation and in particular ultraviolet (UV) radiation has become popular. In such cases, special radiation-curable ink is used and the image is cured by exposure to a curing radiation source. Typically, curing is performed by simultaneously irradiating all image elements with the same amount of curing radiation. The use of radiation-curable inks and the curing process are rapidly becoming an alternative to the established conventional drying process.

Curable ink must be cured within a short time period after it has been deposited on the substrate. Known prior art includes U.S. Pat. No. 6,457,823; U.S. Pat. No. 6,561,640 and United States Patent Application Publication No. 2004/0085423.

SUMMARY OF THE INVENTION

The invention provides a method and apparatus for improving printed image quality. The image quality improvement is achieved by differentially curing different image elements such as continuous tone elements, uniform tinted and solid elements, color elements, line art and text elements. A delay in the activation or variation in the intensity level of the curing radiation, duration of the image irradiation by the curing radiation or a mix of them that follows the ink droplet on substrate deposition, controls the ink droplet spread and accordingly the image quality. In the context of the present invention, image quality among others includes image banding reduction and image sharpness improvement. Banding is a phenomenon of clear visible irregular lines and stripes of a contrasting color that are not present in the digital image data.

According to the exemplary embodiments of the present invention, the quality improvement may be achieved by a method of ink jet printing with radiation curable ink, comprising ejecting droplets of ink onto a substrate to form an image, which includes one or more image elements such as continuous tone, uniform tinted and solid elements, color, line art and text image elements, and controlling the ink droplets spread magnitude by irradiating the image elements by curing radiation. The type of the image element irradiated sets the delay in the activation of the radiation source, the intensity level of the source, duration of the source operation and the profile of the intensity of the source or a mix of all or some of them.

In agreement with one exemplary embodiment of the method of the present invention the delay in the radiation source activation following the ink droplet ejection is determined by the type of the image element to be irradiated.

In agreement with another exemplary embodiment of the method of the present invention the type of the image element to be irradiated determines the intensity level of the radiation.

In agreement with a further exemplary embodiment of the method of the present invention the type of the image element to be irradiated determines the duration of the operation of the curing radiation source and the profile of the intensity of the curing radiation.

In agreement with the method of the present invention, the sources of the curing radiation are selected from a group of ultraviolet, visible or infrared radiation sources as the type of ink may require it.

According to the method of the present invention, the digital form (image data) of the type of image element to be printed controls the radiation source to provide the radiation only to printed portions of the respective image element.

The invention further provides a method of controlling image quality in ink jet printing. A method comprising depositing droplets of ink onto a substrate to form at least one row of pixels comprising different types of image elements, scanning with a scanning radiation beam the row of pixels and controlling the image quality by operating the radiation beam in agreement with the type of image element to be cured. The control of image quality is achieved by delaying the activation of the radiation beam, varying the intensity level of curing radiation and changing the profile of the intensity of the curing radiation as a function of the type of image element to be cured. The type of image element further sets the mix between the delay in the radiation source activation, duration of the radiation source operation, the intensity level of the source and the profile of the intensity.

The present invention provides an apparatus enabling implementation of the method of the present invention. The apparatus includes an ink jet print head for ejecting droplets of ink onto a substrate to form an image, which includes different types of image elements; a radiation emitting source to irradiate the image by radiation and a controller. The apparatus is characterized in that it includes a feature for analyzing the digital form of the image (image data) to be printed and operate the radiation source to differentially cure the ejected ink droplets.

According to the present invention the radiation source may move with the print head and the source may be a linear or two-dimensional array of individually addressable radiation sources as UV LEDs, Visible LEDs, UV or IR laser diodes. Alternatively, the radiation source may be a combination of UV and IR radiation sources. The radiation source may be or a combination of either UV or IR radiation sources only with each of them having different wavelengths. According to an additional embodiment, the radiation source may have a scanning laser beam.

Following the ink droplet deposition the radiation source provides the radiation at a delay determined by the type of the image element to be cured. The delay controls ink droplet spread and accordingly affects the image quality.

The image element to be cured further determines the duration of the radiation source operation. The duration of the radiation source operation controls ink droplet spread and accordingly affects the image quality.

Alternatively, the intensity level and the profile of the intensity provided by the radiation source may be varied and the type of the image element to be cured determines the variation in the radiation intensity. The variation in the radiation intensity level controls ink droplet spread and accordingly the image quality. Additionally, a mix of some or all of the source operational parameters such as the delay in the radiation source operation, the duration of the source operation, the intensity level of the radiation source and the profile of the intensity may be varied.

In agreement with the present invention, a feature for analyzing digital image analyzes the digital form of the image elements and determines the delay, duration, intensity level and the intensity profile of the radiation source operation. The feature, which is a combination of software and hardware, analyzes the digital image data and controls the operation of the radiation source.

The images printed by the apparatus of the present invention have better than images printed by conventional inkjet printing technique quality. The images exhibit less banding in continuous tone, uniform tinted and solid areas and are sharper than images printed by conventional inkjet printing techniques in text and line art areas. Practically, every image area containing a mix of image elements shows improvement in print quality.

The image quality is less dependent on the substrate properties since proper curing sequences controlling ink droplet spread or contraction may be selected for different substrates.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings, in which like reference characters refer to the same parts throughout the different views. The drawings are not necessarily to scale, emphasis instead being placed upon illustrating the principles of the invention.

DETAILED DESCRIPTION OF THE EXEMPLARY EMBODIMENTS

In the following detailed description, numerous specific details are set forth in order to provide a thorough understanding of the invention. However, it will be understood by those of ordinary skill in the art that the present invention may be practiced without these specific details. In other instances, well-known methods and procedures have not been described in detail so as not to obscure the present invention.

Some embodiments of the present invention are directed to curing of ink based on the type of image element of the printed image. The term "curing" throughout the specification and the claims refers to the process of converting a liquid such as, for example, ink to a solid by exposing it to curing radiation. According to some embodiments of the present invention, the curing radiation may be ultraviolet radiation and the ink used for printing may be ultraviolet curable ink. According to other embodiments of the present invention, the curing radiation may be infrared radiation and the ink used for printing may be infrared curable ink. According to additional embodiments, a combination of ultra violet and infrared radiation and respectively curable inks may be used.

Figure 1A:
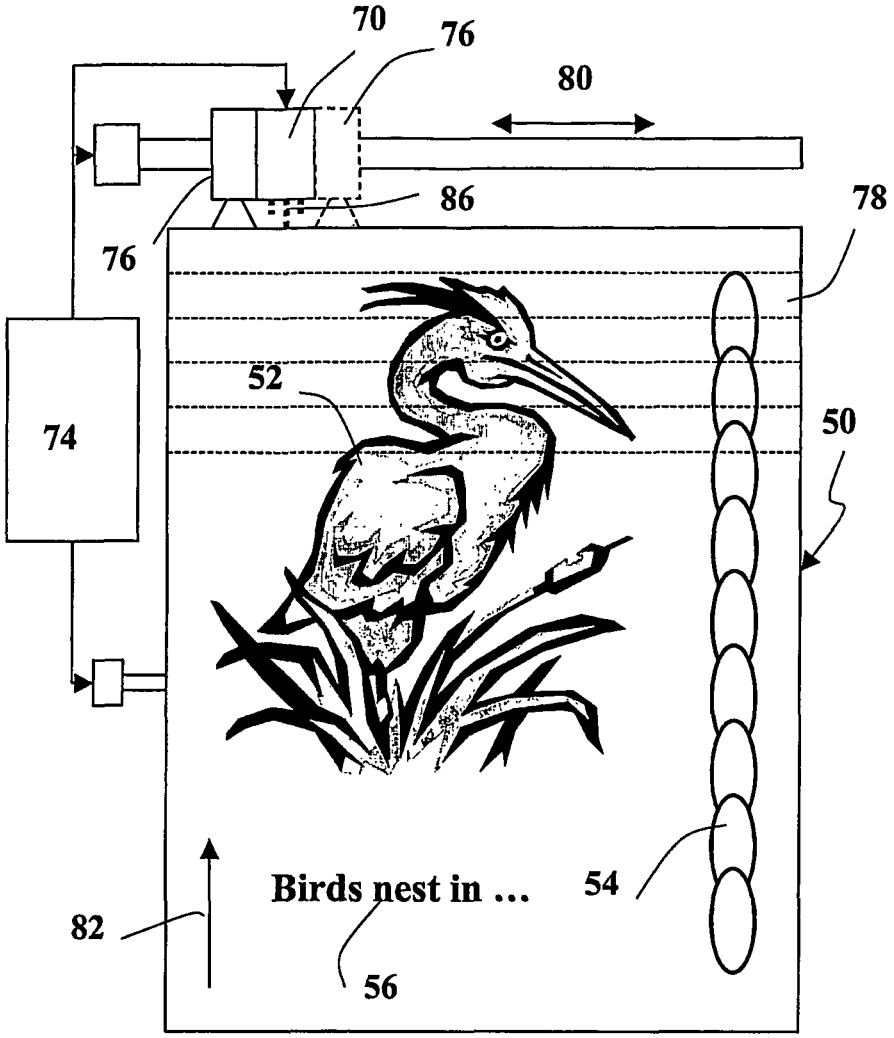
FIG. 1A. PRIOR ART
FIGS. 1A and 1B (Prior Art) are simplified illustrations of a typical printed image and an inkjet printer.

FIG. 1A is a simplified illustration of a typical prior art image printed on substrate 50 and a prior art inkjet printer. Each image usually consists of some image elements such as pictorial or continuous tone elements, uniform tinted and solid elements 52, line art 54 and text elements 56.

The image illustrated in FIG. 1A is printed by a prior art inkjet printer that in its simplest form would have a multi nozzle inkjet print head 70, a controller or a Raster Image Processor (RIP) 74 and a radiation source 76, such as a conventional UV lamp operating in flash or continuous mode. Controller or RIP 74 may be such as a Personal Computer (PC) running appropriate software. During printing, print head 70 moves in the direction indicated by arrow 80 and ejects ink droplets 86 to cover according to the image data a print head wide strip 78 on substrate 50. Radiation source 76 may move together with print head 70 and may cure the ink droplets deposited onto substrate 50.

For bidirectional printing as indicated by arrow 80, a second radiation source 76, shown in phantom lines, may be mounted on the other side of print head 70. The printing may be performed in a mode where each print head path results in a strip of a single color (ink layer). Alternatively, each print head path may result in a strip including a number of colors (ink layers).

Figure 1B:
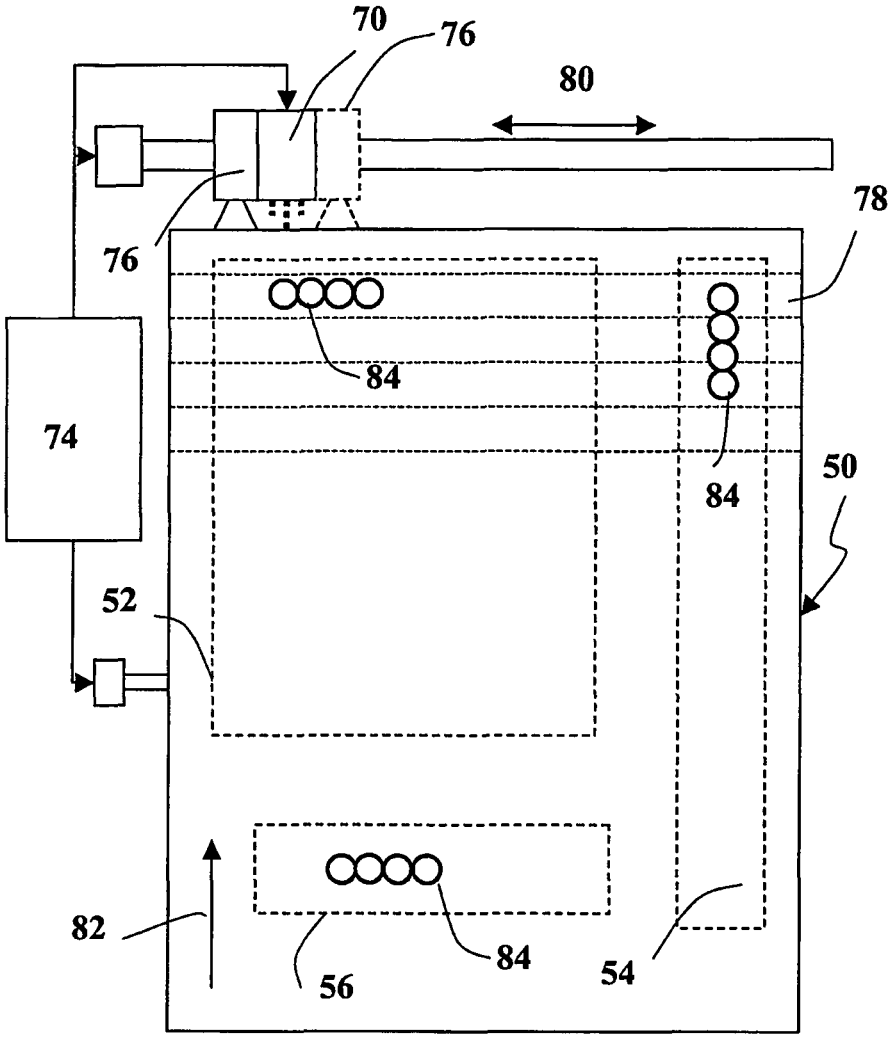
FIG. 1B. PRIOR ART

Print head 70 ejects ink droplets 86 of essentially the same volume. Adjacently positioned on the media ink droplets typically expand so, as to overlap and jointly cover certain area. As shown in FIG. 1B each of the image elements mentioned are printed by the same spot size 84. The term "spot" designates the size (diameter or area) of the deposited on the substrate and cured ink droplet.

Controller 74 controls the operation and movement of inkjet print head 70 and may synchronize the operation of it with the movement of substrate 50 in the direction indicated by arrow 82. Radiation source 76 operates in flash or continuous operation mode to deliver an equal amount of radiation simultaneously to all types of image elements printed onto substrate 50.

Figure 2:
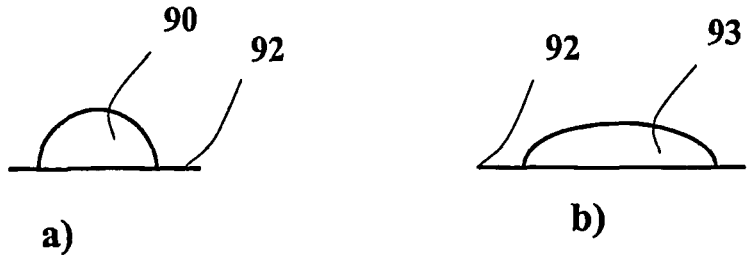
FIG. 2 is a schematic illustration of ink spreading on a wettable substrate.
Figure 3:
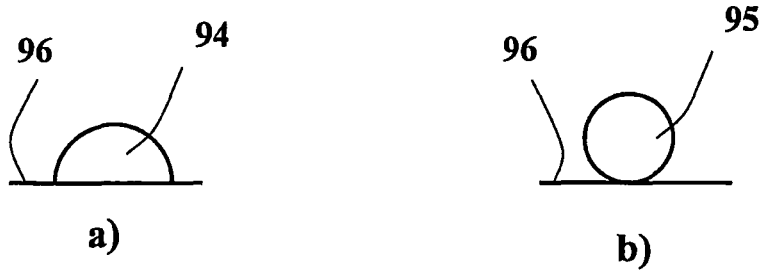
FIG. 3 is a schematic illustration of ink contraction on a non-wettable substrate.

Depending on the ink substrate interaction properties, when an ink droplet 90 is deposited on substrate 92 that has good wetting properties, as shown in FIG. 2, the droplet will over some time expand and spread out to a spot 93 of a larger than droplet 92 size. In some instances that may involve poor wettable substrates 96, as shown in FIG. 3, ink droplet 94 may contract to a spot 95 of a smaller than droplet 94 size. In one case there may be clear visible banding, especially in uniform areas and in the other case there may be blurred or discontinued fine image elements such as text and line art. A printed image in every portion of it usually includes a mix of elements and accordingly the quality of all of them is affected.

Figure 4:
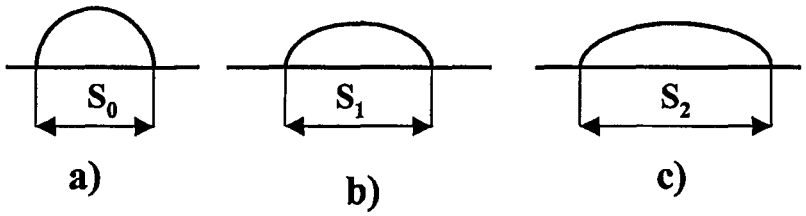
FIG. 4 is a schematic illustration of ink drop behavior at different time intervals following drop on substrate deposition.

FIG. 4 is a schematic illustration of ink drop behavior at different time intervals following droplet on substrate deposition. After deposition, if no curing radiation is applied to it, droplet 90 may continue to spread on substrate 92. The spot size formed by the droplet may have different diameter at each time interval and for the particular example described the relation of the spot diameter or surface area is $S_0<S_1<S_2$.

Figure 6A:
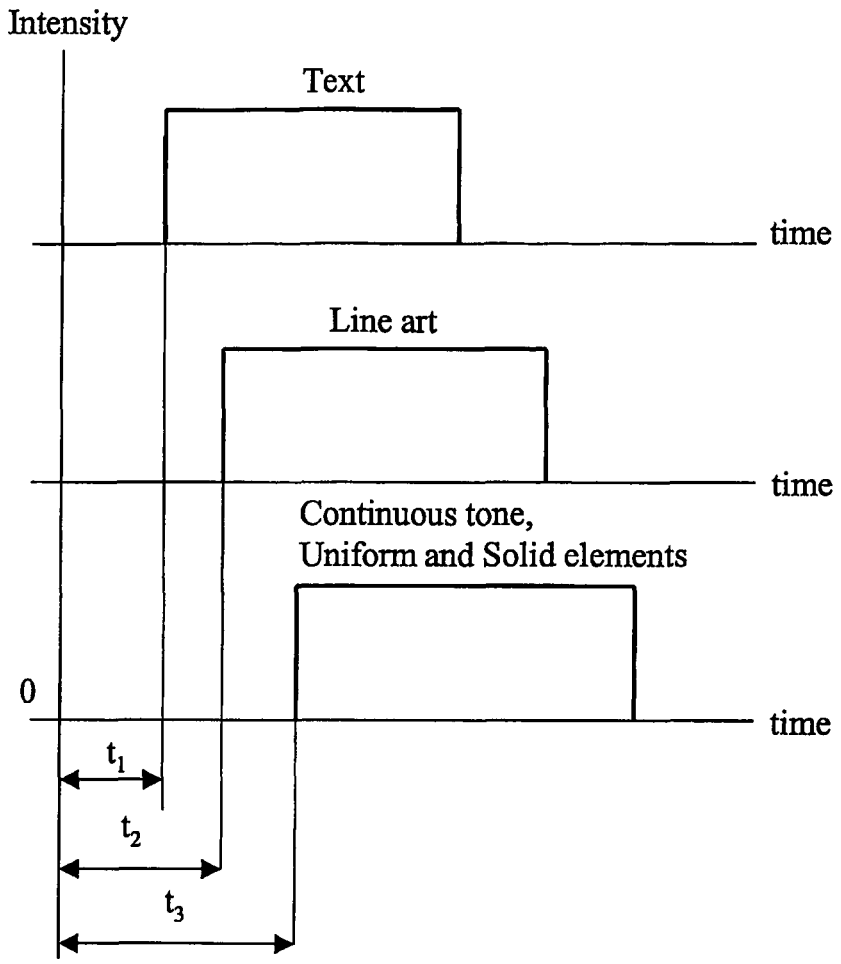
FIGS. 6A-6C are schematic illustrations of the delay in the radiation source activation for curing of different image elements, intensity variation and a combination of delay and intensity profile changes respectively according to the present invention.

Printing with radiation curable ink provides an opportunity of controlling ink droplet spread differentially according to the type of the image element printed. The differential ink droplet spread and associated with it spot overlap control may be achieved by applying the curing radiation to different image elements at different time delays as shown in FIG. 6A, which is a schematic illustration of differential curing of different image elements. The differential curing may be achieved; for example, by making the delay in the activation of the curing radiation source $t_1$ following ink droplet ejection for curing the text image element shorter than the delay $t_3$ in the operation of the curing radiation source for curing the continuous tone or uniform area image element.

Figure 6B:
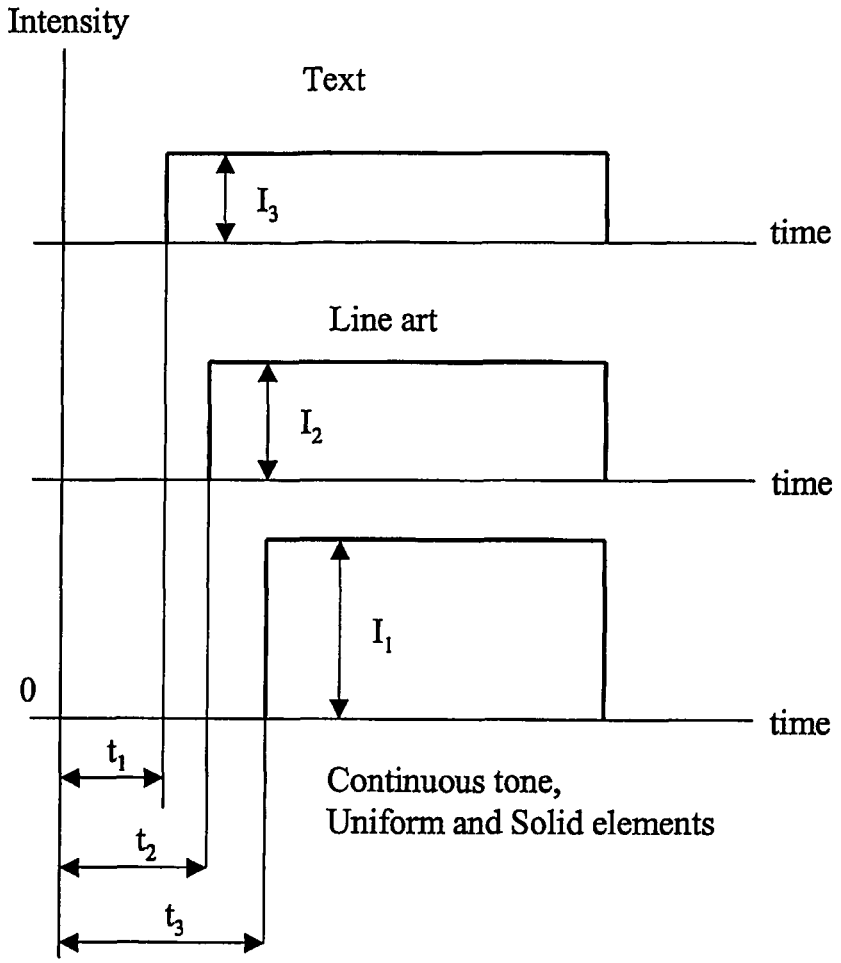

Radiation source intensity level, duration of the irradiation of the image and profile of the irradiation intensity may also be used for differential control of ink droplet spread. The type of the image element to be irradiated (continuous tone, uniform solid etc.) may be used for setting the radiation intensity level, profile or duration. FIG. 6B is a schematic illustration of differential curing different image elements where the radiation source intensity level is changed according to the image element to be cured. For example, the intensity of the curing radiation source $I_3$ for curing the text image element may be lower than the intensity $I_1$ of the curing radiation source for curing the continuous tone or uniform area image element.

Figure 6C:
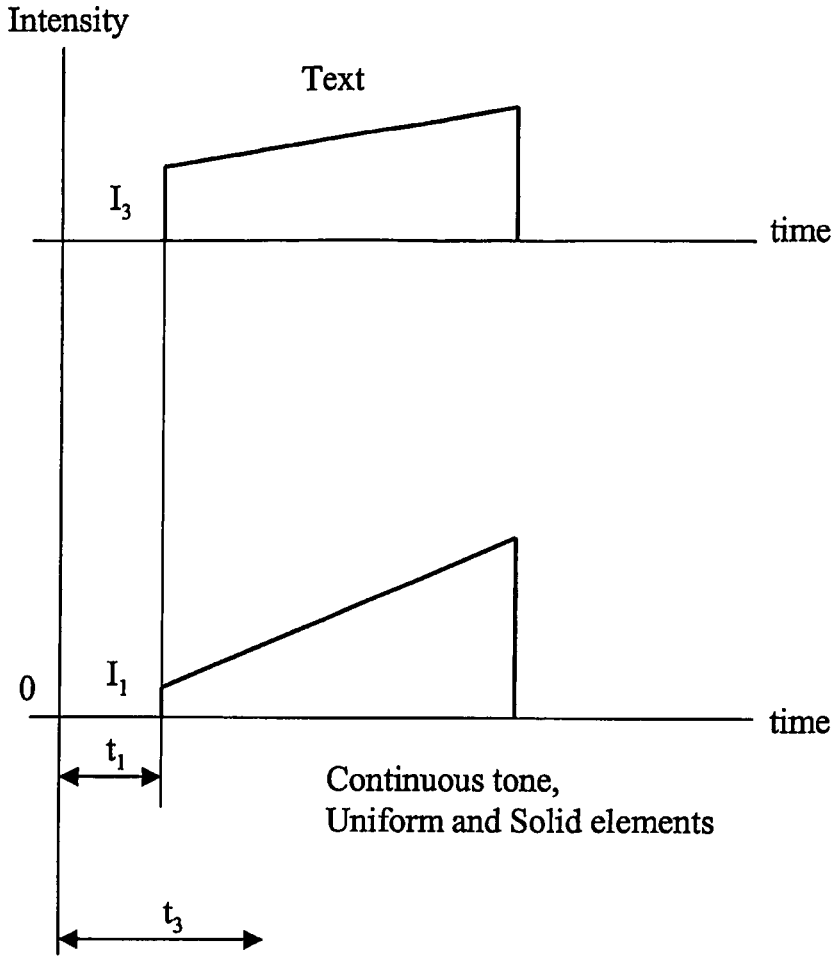

FIG. 6C is a schematic illustration of differential curing of different image elements where the radiation intensity profile is changed in a ramp form according to the image element cured. For example, the intensity of the curing radiation source $I_3$ for curing the text image element may start at a value higher than the intensity $I_1$ of the curing radiation source for curing the continuous tone or uniform area image element. In some cases, a mix of the intensity level, delay in activation of the radiation source, duration of the source operation or intensity profile may be present.

Printing by a droplet having larger spread or overlap allows reducing banding of continuous tone, uniform tinted and solid image elements. Droplets with larger spread or overlap mask the visible artifacts on uniform areas. Printing with droplets having smaller spread or overlap may allow increasing the sharpness of the text and line art image elements.

Figure 7:
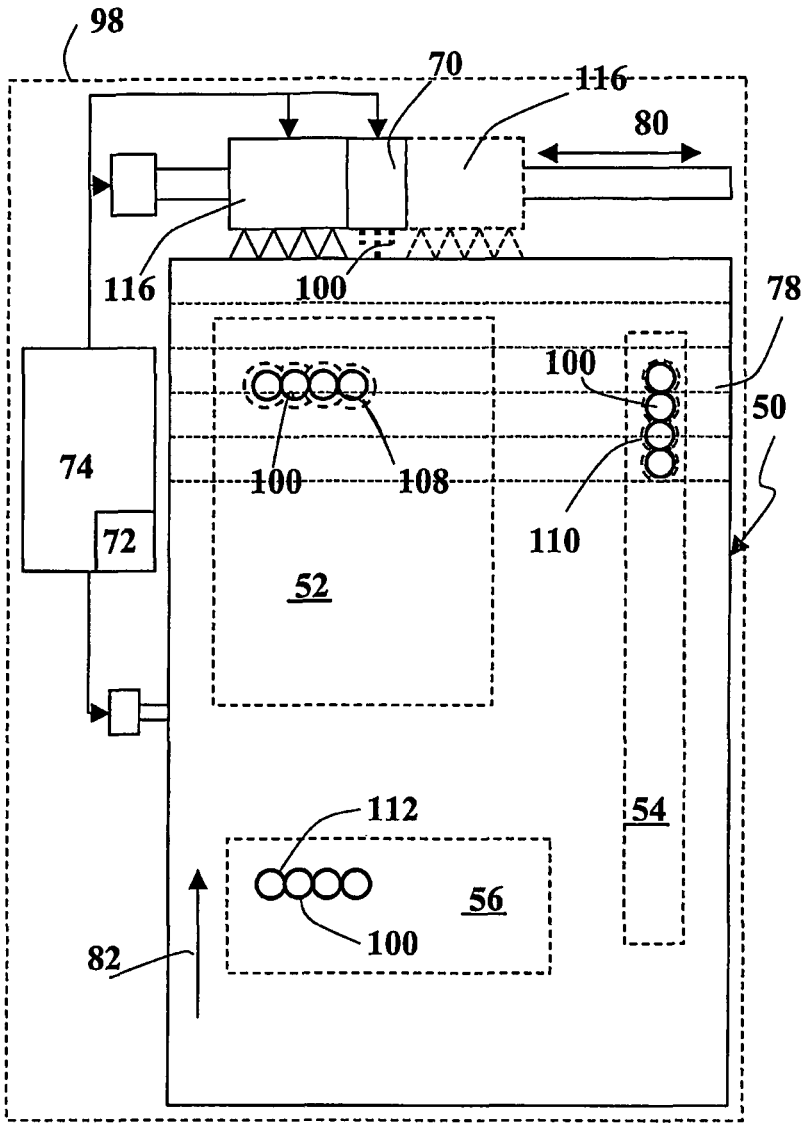
FIG. 7 is a schematic illustration of an inkjet printing apparatus constructed according to the present invention and an image printed by the apparatus.

FIG. 7 is a schematic illustration of an embodiment of an inkjet printing apparatus of the present invention and an image printed by the apparatus. The inkjet printing apparatus 98 may print with radiation curable ink. Print head 70 may eject droplets of ink 100 onto substrate 50 to form an image, which includes continuous tone, uniform tinted and solid areas 52, line art 54 and text 56 image elements. For the clarity of the explanation, the boundaries of each image element are schematically shown as rectangles bounded by phantom lines, although in practice different image elements are printed on common sections of the substrate.

Curing radiation source 116 cures ejected ink droplets. In one of the embodiments curing radiation source 116 may be a linear or two-dimensional array of individually addressable UV, Visible or IR Light Emitting Diodes (LED) or UV or IR lasers or laser diodes (collectively termed radiation emitters), depending on the type of ink used. Source 116 may be extended in the print head 70 scanning direction indicated by arrow 80 such as to enable sufficiently long delays and curing times of different image elements. Source 116 may have some image forming optics enabling irradiation of image sections as small as a single printed droplet or pixel spot size or any other spot size required.

Figure 5:
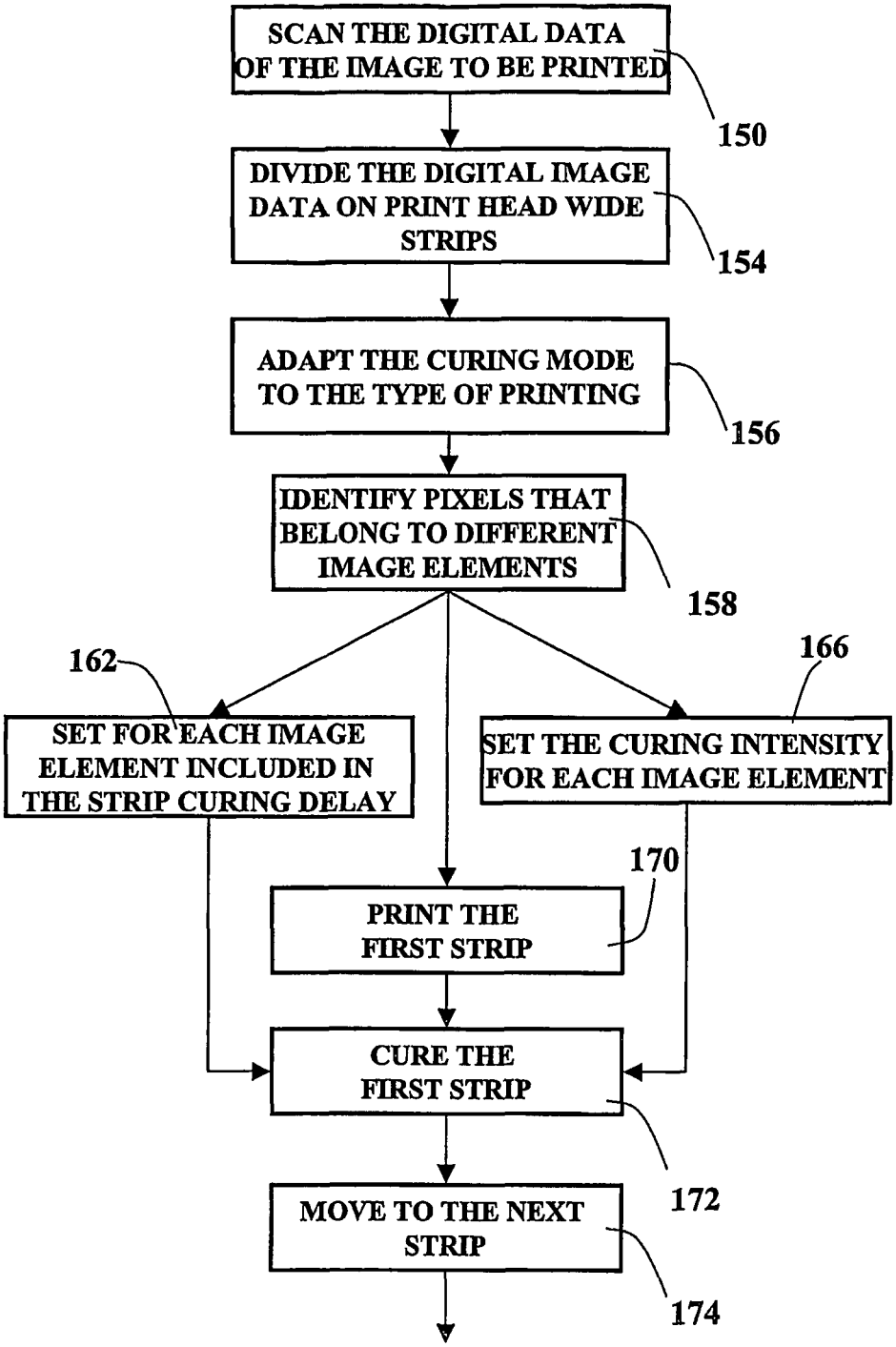
FIG. 5 is a schematic flow chart of the method of image quality improvement of the present invention.

In order to establish the required delay in the application of the curing radiation or the intensity of the curing radiation prior to printing or concurrently with the printing process the digital data of the image to be printed may be preprocessed as shown in FIG. 5. Controller 74 that serves as a Raster Image Processor (RIP) may have a feature 72 for analyzing the digital image data to be printed. Feature 72 may be software operating on the controller or a combination of software and dedicated hardware. Feature 72 may scan the digital representation of the image (image data) to be printed (block 150) and divide it into print head wide strips (block 154). Each strip generally may contain continuous tone, line art and text elements, uniform tinted and solid elements as well as distinct color (for example, Pantone colors) areas to be printed.

The curing source operation may be adapted to the printing mode (block 156). Depending on the printing mode whether a strip of single color (ink layer) or a number of colors (ink layers) are printed simultaneously the emphasis may be placed: on the delay in the activation of the source; on the intensity level of the source; on the profile of the intensity of the source; on the duration of the irradiation of the printed image, or a mix of all or some of the above mentioned parameters. Accordingly, the most appropriate type of curing may be selected.

Feature 72 may identify all of the pixels belonging to a specific image element (block 158) and included in the particular image strip (block 154). Feature 72 may set for each image element the delay (FIG. 6A) in radiation source activation following said ink droplet ejection (block 162) or droplet on substrate deposition. The delay in the activation of the radiation source may be determined by analyzing the digital data of the image element to be printed. The intensity level of the radiation source (block 166) may be set by analyzing the digital data of the image element to be printed. In a similar way, analyzing the digital data of the image element to be printed, feature 72 may set the profile of the intensity of the source (FIG. 6C) and the duration of the irradiation of the printed image, or a mix of all or some of the above-mentioned parameters.

The digital data pertaining to the image element to be printed may directly control radiation source 116 (FIG. 7) and operate the linear or two-dimensional array of radiation sources. In addition to this, the digital data may be used to provide the radiation only to printed portions of the respective image element. Image forming optics may be built to facilitate supply of the radiation to the printed droplets of the respective image element. The linear or two-dimensional array of radiation sources may be such radiation emitters as UV LEDs, Visible LEDs; UV or IR laser diodes. Alternatively, radiation source 116 may be a combination of UV and IR radiation sources. Source 116 may be a combination of UV (or IR) only radiation sources operating at different wavelengths. Both the print head and the radiation source may be on the same carriage and move together or each may have separate movement mechanism. In the case of a separate movement mechanism, the print head movement and the movement of the source may be synchronized.

In order to get proper curing it may be necessary to adjust in addition to the delay the intensity level of the radiation source (block 166), the profile of the intensity of the source, the duration of the irradiation action or all of the above together. Analysis of the digital data of the image element may set each of the parameters or a mix of them. FIGS. 6A-6C respectively illustrate such cases. Following this, the printing process may begin and print head 70 prints first strip (block 170) and radiation source 116 cures it (block 172). The type of image element cured controls delay in the activation of radiation source 116 and the intensity of source 116 and if set other listed above parameters. Following completion of the first strip printing substrate 50 is advanced in direction of arrow 82 and the next strip is printed (block 174). Although the printing (block 170) and curing (block 172) are shown as sequential steps it possible to envision an apparatus structure where curing takes place almost simultaneously with printing.

Figure 8:
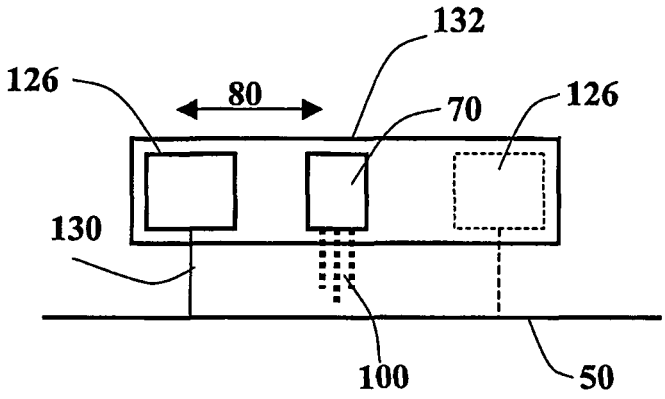
FIG. 8 is a schematic illustration of an inkjet printing apparatus with a scanning curing radiation source according to the present invention.

In an alternative embodiment radiation source 116 may be replaced by a radiation source 126 (FIG. 8) having one or more than one scanning laser beams 130. The scanning direction of beam 130 is across the array of pixels printed by each nozzle or orthogonal to the print head 70 movement direction 80. Both radiation source 126 and print head 70 may be placed on a common carriage 132. Alternatively, the laser sources may have independent drive systems. Depending on the type of ink used and power required it may be an UV laser, a LED or an IR laser diode (radiation emitters) with any scanning mechanism meeting the application requirements. Methods of varying or delaying scanning laser beam activation and/or the intensity of the beam, and/or the duration of the irradiation action as a function of the type of image element printed are similar to the disclosed above.

As schematically illustrated in FIG. 7 the method of printing by ink droplets 100 having substantially identical volume may result in printing continuous tone, uniform tinted and solid image elements 52 with a spot size or overlap 108, shown in phantom lines, larger than the spot size (overlap) 110 of line art 54 and larger than spot size (overlap) 112 of text 56. It is necessary to mention that in a vast majority of cases two spot sizes, for example, one for continuous tone, uniform tinted and solid image elements and another one for line art could provide the desired improvement since the line art and text may be printed by a similar spot size.

Figure 9:
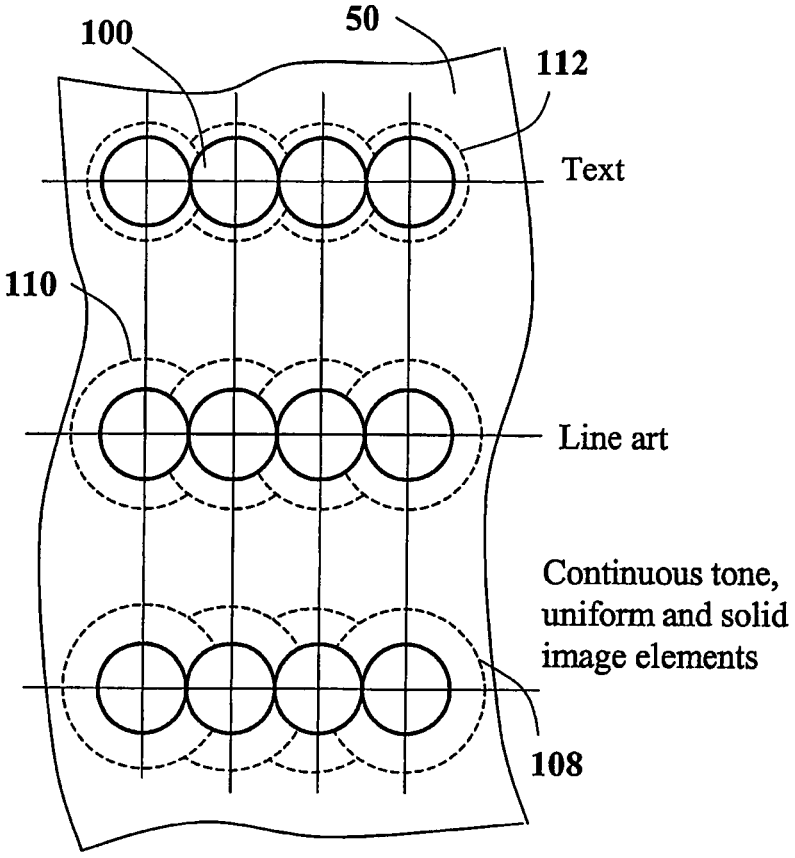
FIG. 9 is a schematic illustration of magnified spot sizes of different image elements printed using differential curing timing according to the present invention.

FIG. 9, which is a schematic illustration of magnified spot sizes of different image elements printed using differential curing according to the present invention, illustrates the differences in the overlaps in detail.

Figure 10:
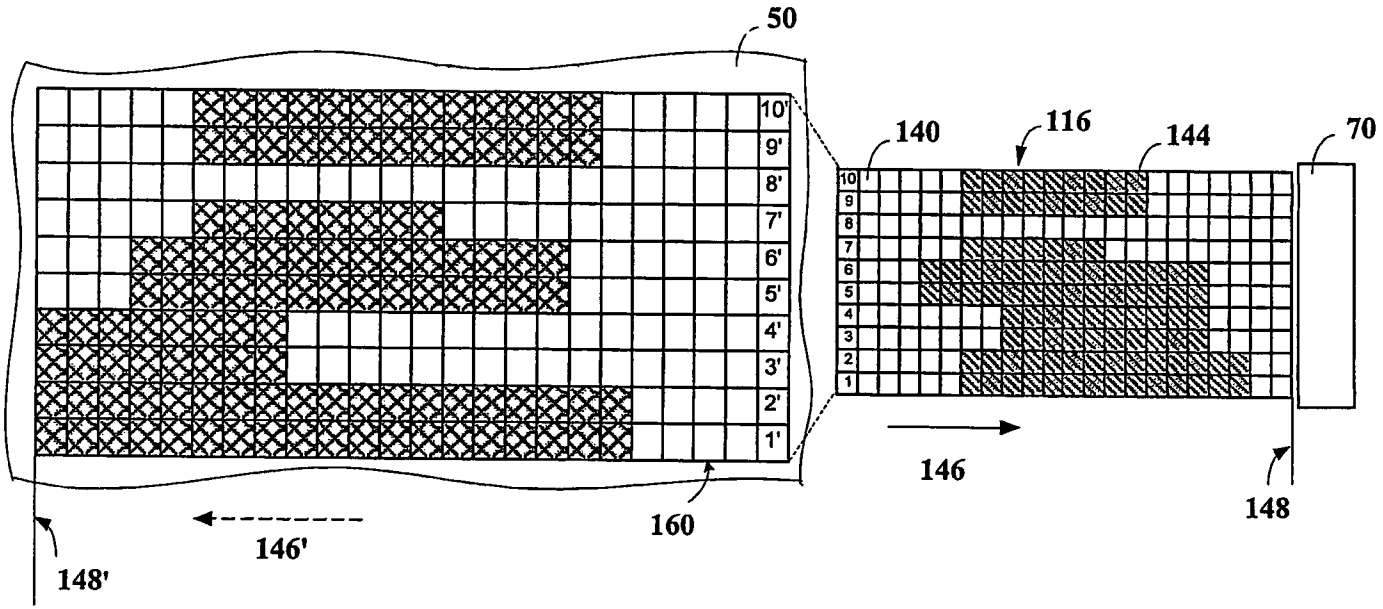
FIG. 10 is a schematic illustration of the operation of a curing radiation source according to the present invention.

FIG. 10 shows an exemplary embodiment of curing radiation source 116. Source 116 may be a linear or a two-dimensional array of individually addressable radiation emitters 140. Feature 72 (or controller 74) dedicated to the control of radiation source 116 may switch ON or OFF each of radiation emitters 140 setting the delay in the activation of an array and of each of radiation emitters 140, intensity level, intensity profile and irradiation action duration according to the digital image data processed by feature 72. The feature may identify all of the pixels belonging to a specific image element and included in the particular image strip. Controller 74 may set the intensity of each of radiation emitters 140 according to the digital image data processed by the feature or a mix of intensity and delay and duration of the irradiation process. For exemplary purposes only, source 116 is shown as including 10 (ten) linear arrays of radiation emitters 140. Arrow 146 indicates the print head movement direction. Alternatively, as shown by arrow 146' the substrate may move. In order to simplify the explanation drop ejection may occur, for example, at a time when first line 148 of radiation source passes over the corresponding line 148' of image 160 printed on substrate 50.

Hatched squares mark pixels of image 160 where droplets of ink were placed. Arrays 1, 2, 5, 6, 9 and 10 may cure corresponding printed image lines marked by similar tagged numbers of text or line art image and may have a delay schematically shown as two not operating radiation emitters 140 that pass over the printed image. (Slanted lines mark activated radiation emitters 144.) The delay in the operation of arrays 5, 6, 9 and 10 in addition to the required delay (two radiation emitters) includes the delay caused by their position on the substrate. Arrays 3, 4 and 7 may cure continuous tone or uniform tinted and solid art areas and may have a delay in their activation schematically shown as five non-operating radiation emitters. The delay in the operation of array 7 in addition to the required delay (five radiation emitters) includes the delay caused by its position on the substrate. Array 8 may be not operative and may be passing over image free area. Controller 74 synchronizes the delay, intensity, duration and profile or a mix of the delay, intensity, duration and profile in operation of each individual radiation emitter 140 with the type of image and image on substrate position.

The images printed by the method of the present invention have banding free continuous tone, uniform tinted and solid areas and much sharper text and line art images than images printed by conventional inkjet techniques.

The image quality is less dependent on the substrate since proper curing sequences controlling ink droplet spread or contraction may be selected for different substrates.

A number of embodiments have been described. Nevertheless, it will be understood that various modifications may be made without departing from the spirit and scope of the invention. Accordingly, other embodiments are within the scope of the following claims.

What is claimed is:

1. A method of controlling printed image quality comprising:

ejecting droplets of ink onto a substrate to form an image said image including a plurality of different types of image elements, and irradiating said image with a curing radiation, wherein different image elements of said image are irradiated using different radiation parameters, said radiation parameters comprising:

a delay between ejecting said droplets of ink onto said substrate and irradiating a corresponding image element, said delay being based on a type of said image element to be irradiated such that droplets for at least one type of image element are allowed to spread more prior to curing than droplets for at least one other type of image element; and an intensity of said curing radiation source, a linear variation of said intensity of said curing radiation source being based on a type of said image element to be irradiated.

2. The method of claim 1, wherein said different types of image elements comprises at least one of continuous tone, uniform tinted and solid elements, color, text and line art elements.

3. The method of claim 1, wherein said image quality further comprises image banding and image sharpness.

4. The method of claim 1, wherein a mix between the delay in said source activation and the intensity of said source are determined by said type of image element to be irradiated.

5. The method of claim 4, wherein said mix between the delay in said source activation and the intensity of said source are determined by a printing mode.

6. The method of claim 1, wherein said parameters are determined by analyzing the digital form (data) of said image element.

7. The method of claim 1, wherein said irradiating is performed with a curing radiation source that comprises one of a group of ultraviolet, visible and infra red radiation emitters, a mix of them and ultraviolet or infra red emitters having different wavelengths.

8. The method of claim 1, wherein said irradiating is performed with a radiation source that is a linear array of individually addressable radiation emitters.

9. The method of claim 1, wherein said irradiating is performed with a radiation source that comprises a two dimensional array of individually addressable radiation emitters.

10. The method of claim 1, wherein said type of image element printed controls said source to provide said curing radiation only to printed portions of said image.

11. The method of claim 1, wherein said irradiating is performed with a radiation source that further comprises an ultraviolet radiation source.

12. The method of claim 1, wherein said radiation parameters further comprise duration, such that a duration of said irradiating a particular image element is determined based on a type of that image element.

13. The method of claim 1, wherein said radiation parameters further comprise an intensity profile, such that a variation in an intensity of said curing radiation over a period of time the curing radiation is applied to a particular image element is determined based on a type of that image element.

14. A method of controlling image quality in ink jet printing, comprising:

depositing droplets of ink onto a substrate to form at least one row of pixels comprising different types of image elements;

scanning said row of pixels with a curing radiation beam; and controlling said image quality by selecting operational parameters of said radiation beam, said operational parameters comprising:

a delay between depositing said droplets of ink onto said substrate and irradiating a corresponding image element with said curing radiation beam, said delay being based on a type of image element to be cured; and an intensity of said curing radiation source, a linear variation of said intensity of said curing radiation source being based on a type of said image element to be irradiated.

15. The method of claim 14, wherein said image quality further comprises image banding and image sharpness.

16. The method of claim 14, wherein said operational parameters of said beam further comprise intensity of said beam.

17. An apparatus comprising:

an ink jet print head to eject droplets of ink onto a substrate to form an image comprising different types of image elements;

a curing radiation source to irradiate said image by radiation; and a feature for analyzing the digital form (data) of said different image elements to be printed and for operating said source to differentially cure said ejected ink droplets;

wherein said feature operates said source with a variable delay between ejecting droplets of ink onto said substrate for a particular image element and irradiating that image element, said delay being based on a type of said image element to be irradiated such that droplets for at least one type of image element are allowed to spread more prior to curing than droplets for at least one other type of image element; and wherein said feature operates said source with a variable intensity, a linear variation of said intensity of said curing radiation source being based on a type of said image element to be irradiated.

18. The apparatus of claim 17, wherein said source is rigidly connected with said print head.

19. The apparatus of claim 17, wherein said radiation source movement is synchronized with said print head movement.

20. The apparatus of claim 17, wherein said source provides curing radiation to different image elements at an intensity level determined by the type of said image element to be cured.

21. The apparatus of claim 17, wherein said source provides curing radiation to different image elements at a mix of delay and intensity level determined by the type of said image element to be cured.

22. The apparatus of claim 17, wherein said radiation source is one of a group of UV LED, Visible LED, IR LED, UV laser diode, IR laser diode, a mix of UV and IR radiation emitters or a combination of UV or IR emitters having different wavelengths.

23. The apparatus of claim 17, wherein said source is a linear array of individually addressable radiation emitters.

24. The apparatus of claim 17, wherein said source comprises a two dimensional array of individually addressable radiation emitters.

25. The apparatus of claim 17, wherein said source is extended along the scanning direction.

26. The apparatus of claim 17, wherein said source comprises a scanning beam.

27. The apparatus of claim 17, wherein said feature for analyzing digital image generates the data for the control of said source.

28. A method of controlling image quality comprising:

ejecting droplets of ink onto a substrate to form an image said image including a plurality of different types of image elements, and controlling said ink droplets spread by irradiating said image elements by a curing radiation, with a variable delay between ejecting said droplets for a particular image element and irradiating that image element with said curing radiation, said delay being determined based on the type of said image element to be irradiated; and irradiating said droplets with a varying intensity of said curing radiation source, a linear variation of said intensity of said curing radiation source being based on a type of said image element to be irradiated.

29. The method of claim 28, wherein said plurality of image elements comprises continuous tone, uniform tinted and solid elements, color, text and line art elements.

30. A method of controlling printed image quality comprising:

ejecting droplets of ink onto a substrate to form an image on a sheet of print medium, said image including a plurality of different types of image elements within said image, and irradiating said image with a curing radiation, wherein different portions of said image comprising different types of image elements are irradiated at different times such that a delay between ejecting said droplets of ink onto said substrate and irradiating a corresponding image element varies based on the type of image element being irradiated such that droplets for at least one type of image element are allowed to spread more prior to curing than droplets for at least one other type of image element; and in which different portions of said image comprising different types of image elements are irradiated at an intensity of said curing radiation source, a linear variation of said intensity of said curing radiation source being based on the type of said image element to be irradiated.

* * * * *